United States Patent [19]

Sagawa et al.

[11] Patent Number: 4,575,368

[45] Date of Patent: Mar. 11, 1986

[54] METHOD AND APPARATUS FOR MAKING FILTERS

[75] Inventors: Takayoshi Sagawa; Ichiro Hirose, both of Hiratsuka, Japan

[73] Assignee: The Japan Tobacco & Salt Public Corporation, Tokyo, Japan

[21] Appl. No.: 515,900

[22] Filed: Jul. 21, 1983

[51] Int. Cl.[4] ..... A24D 3/02

[52] U.S. Cl. ..... 493/49; 131/69; 131/37

[58] Field of Search ..... 493/39, 41, 42, 45, 493/49, 47; 131/68, 69, 35, 37, 90, 60, 67

[56] References Cited

U.S. PATENT DOCUMENTS 1,117,527 11/1914 Simon ..... 131/69

3,380,351 4/1968 Cox et al. ..... 131/69

FOREIGN PATENT DOCUMENTS 0275380 10/1969 Austria ..... 493/47

0927927 6/1963 United Kingdom ..... 131/69

*Primary Examiner*—V. Millin

*Assistant Examiner*—H. Macey

*Attorney, Agent, or Firm*—Armstrong, Nikaido, Marmelstein & Kubovcik

[57] ABSTRACT

A method and apparatus for manufacturing tobacco filters are provided. Tobacco filter components are placed on a tape of wrapping paper which has a larger edge-to-edge size than the circumference of the filter components. Said tape is guided around the filter components at its first part which is adjacent one of the edges to half wrap the filter component. Paste is applied to the first part surface which faces radially outwardly and then, the tape is guided around the filter components at its second part which is adjacent the other one of the edges to lap over said paste-applied first part.

12 Claims, 11 Drawing Figures

METHOD AND APPARATUS FOR MAKING FILTERS

BACKGROUND OF THE INVENTION

The present invention relates to the method and apparatus for manufacturing tobacco filters. In recent years there are growing demands for paper-rolled tobacco in which a filter wrapping paper for connecting the paper-rolled tobacco rod and the filter tip is perforated to introduce air. A filter wrapping paper covering the outer circumference of the filter tip has high permeability to air (1,000 ml/mm or more).

In a conventional paste applying device as shown in FIG. 1, in which vinyl acetate paste is applied by a paste transfer roller 1 to the back of one end 4B of filter wrapping paper which is to be folded around the filter component and lapped over the other end of paper, there is a disadvantage that the paste applied to the back of the filter wrapping paper oozes to the front side, making the filter sticky and thereby causing troubles to the machine.

Another conventional device where hot-melt bonding agent is applied to the end 4B of the filter wrapping paper also has the same disadvantage though the problem of paste permeation to the front side is less critical than the device using the vinyl acetate paste.

SUMMARY OF THE INVENTION

This invention has been accomplished to overcome the above-mentioned drawback.

In one aspect of the present invention, there is essentially provided a method of making filter comprising the step of applying paste to the surface of one end of a filter wrapping paper folded around the filter component, and lapping the other end of the filter wrapping paper over the pasted end to bond the ends together.

In another aspect, a filter making apparatus comprises a filter component supply means; a filter wrapping paper supply means; a filter wrapping paper folding means; a drying means; and a paste applying means installed in the filter wrapping paper folding means, the paste applying means being adapted to apply paste to the surface of one end of filter wrapping paper which is lapped over by the other end of the paper.

BRIEF DESCRIPTION OF THE DRAWINGS

The foregoing advantage of the invention will be described with reference to the drawings in which.

DETAILED DESCRIPTION OF THE DRAWINGS

Figure 2:
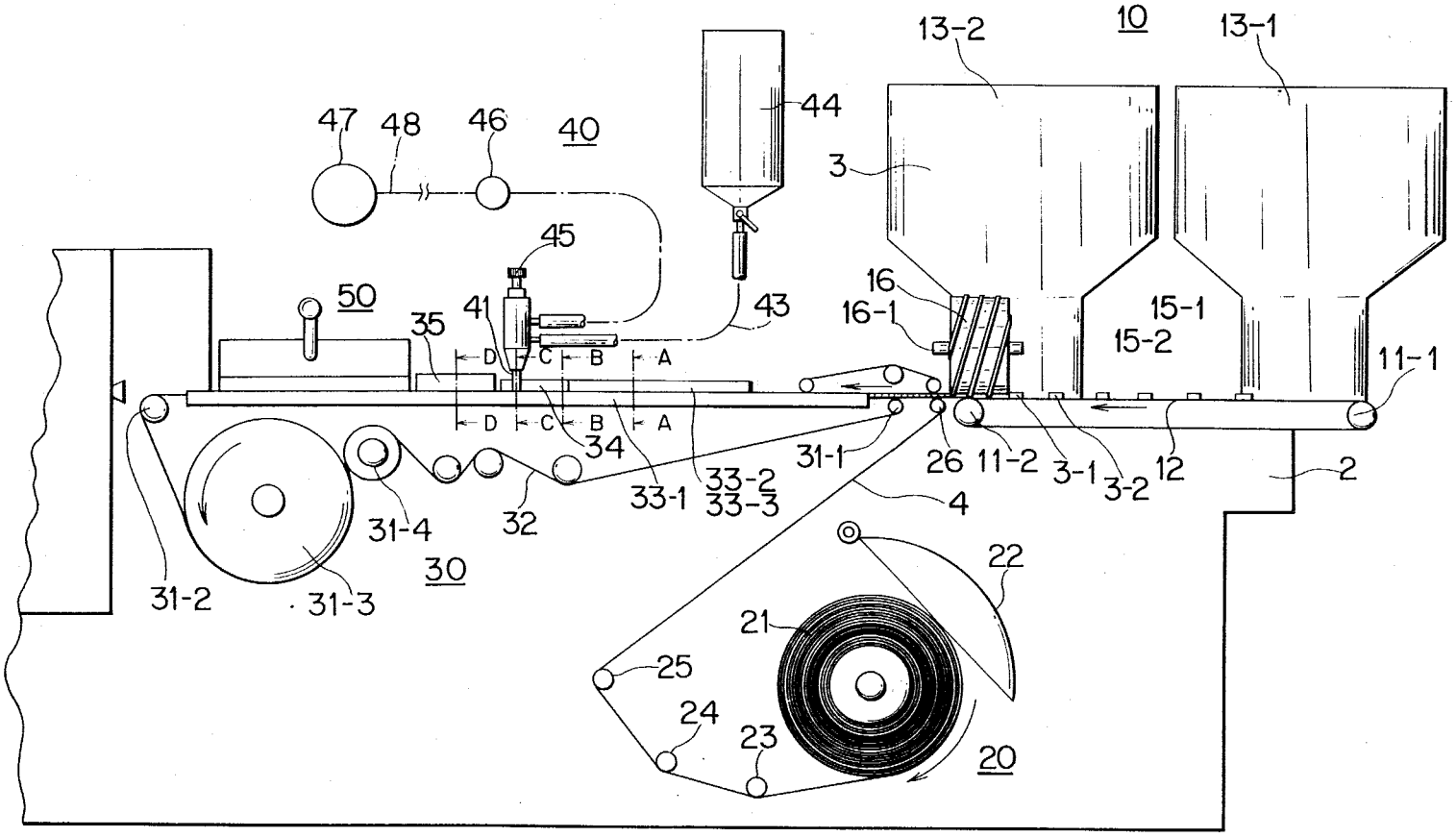
FIG. 2 is a side view of a dual filter manufacturing apparatus embodying the present invention.

In the following, the present invention will be described in detail taking up by way of an example one embodiment as shown in the attached drawings. FIG. 2 shows the schematic side view of a dual filter manufacturing apparatus in which two kinds of filter components supplied from hoppers 13-1, 13-2 are cut into smaller sections and are alternated to form a line of filters. This embodiment comprises a filter component supply section 10, a filter wrapping paper folding section 30, a drying section 50, a filter wrapping paper supply section 20 installed between the filter component supply section 10 and the filter wrapping paper folding section 30, and a paste applying section 40 installed in the filter wrapping paper folding section 30.

The filter component supply section 10 is generally of known type as disclosed in U.S. Pat. No. 3,131,612 and includes: a conveyor 12 passing around two rollers 11-1 and 11-2 on the bed 2 and driven toward the direction of arrow; hoppers 13-1, 13-2 mounted above the conveyor 12; fluted transfer drums (not shown) installed between the hoppers 13-1, 13-2 and the conveyor 12; circular knives (not shown) mounted on the circumference of said two fluted transfer drums; a chain conveyor (not shown) installed almost perpendicular to the conveyor 12 and running along the grooves of the transfer drums; a rotating disk (not shown) mounted horizontally rotatable between the fluted transfer drums and the conveyor 12 and having a plurality of feed claws on the outer circumference; and a drum 16 with spiral threads adapted to rotate about the axis 16-1, installed immediately above the outlet of the conveyor 12. Two kinds of filter components in the two hoppers 13-1 and 13-2 are fed to the grooved transfer drums where they are cut by the circular knives into a number of smaller sections and then supplied by the chain conveyor (not shown) one by one to the feed claw of the rotating disk (not shown). The two kinds of filter component sections are supplied alternately at regular intervals from the rotating disk onto the conveyor 12. The filter components 3-1 and 3-2 on the conveyor 12 have a predetermined circumference, respectively, and are put close together in train without gap between them by the spiral-threaded drum 16 and then fed onto the filter forming paper 4 of the next process.

The filter wrapping paper supply section 20 has a filter wrapping paper charging device 21, a feed break 22, and guide rollers 23, 24, 25, and 26. Said filter wrapping paper supply section 20 feeds a tape 4 of filter wrapping paper in a substantially streched condition by means of said feed break 22, and guide rollers 23, 24, 25 and 26 in cooperation with a filter wrapping paper folding section which will be described later. Said tape 4 has an edge-to-edge size larger than the circumference of the filter components and is fed to the filter wrapping paper folding section 30 with its first surface facing upward and its second surface facing downward.

Figure 4:
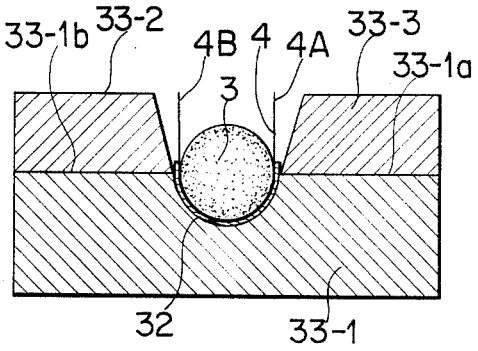
FIGS. 4 through 7 are cross-sectional views taken along the lines A—A, B—B, C—C and D—D of FIG. 2.
Figure 5:
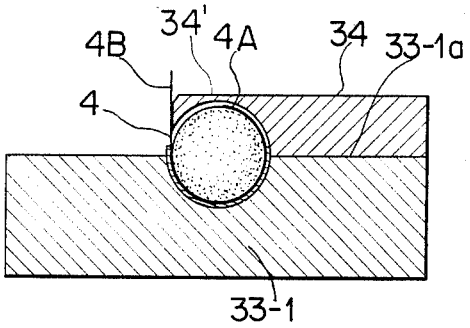
Figure 6:
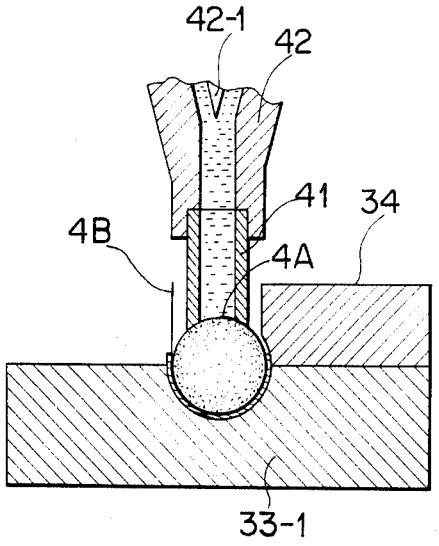

The filter wrapping paper folding section 30 has a tape belt 32 which passes through rollers 31-1, 31-2, 31-3, and 31-4 mounted on the bed 2 along the same line as the conveyor 12 and which is driven in the direction of arrow. Said section 30 also has an elongated common lower guide 33-1 extending beneath said tube tape 32 in said direction marked by the arrow. Said common lower guide 33-1 has a lower semi-circular groove formed therein facing upward and first and second elevated surfaces on both sides thereof. The most upstream portion of said elongated common lower guide 33-1 carries a pair of preliminary guides 33-2 and 33-3 on the respective first and second elevated surfaces 33-1*a* and 33-1*b* to guide the tape belt 32 in a semi-circular shape as best shown in FIG. 4. Downstream of said pair of preliminary guides 33-2 and 33-3, there is provided a first upper guide 34 mounted on said first elevated surface 33-1*a*. Said first upper guide 34 has a substantially same width as the first elevated surface 33-1*a* at a most upstream portion thereof but has a first projection 34' extending over said lower semi-circular groove increasingly toward a downstream portion thereof. Said first projection 34' is formed with a first upper semi-circular groove facing downward and aligning with the lower semi-circular groove to define a first guide passage (FIGS. 5 and 6). Further downstream of said first upper guide 34, there is provide a second upper guide 35 on said second elevated surface 33-1*b* with a suitable spacing from said first upper guide 34. Said second upper guide 35 has a substantially same width as said second elevated surface at a most upstream portion thereof but has a second projection 35' extending over said lower semi-ircular groove increasingly toward a downstream portion thereof. Said second projection 35' is formed with a second upper semi-circular groove facing downward and aligning with the lower semi-circular groove to define a second guide passage. Said second projection 35' finally extend to lap over the first elevated 33-1*a* as shown FIG. 7.

Figure 8:
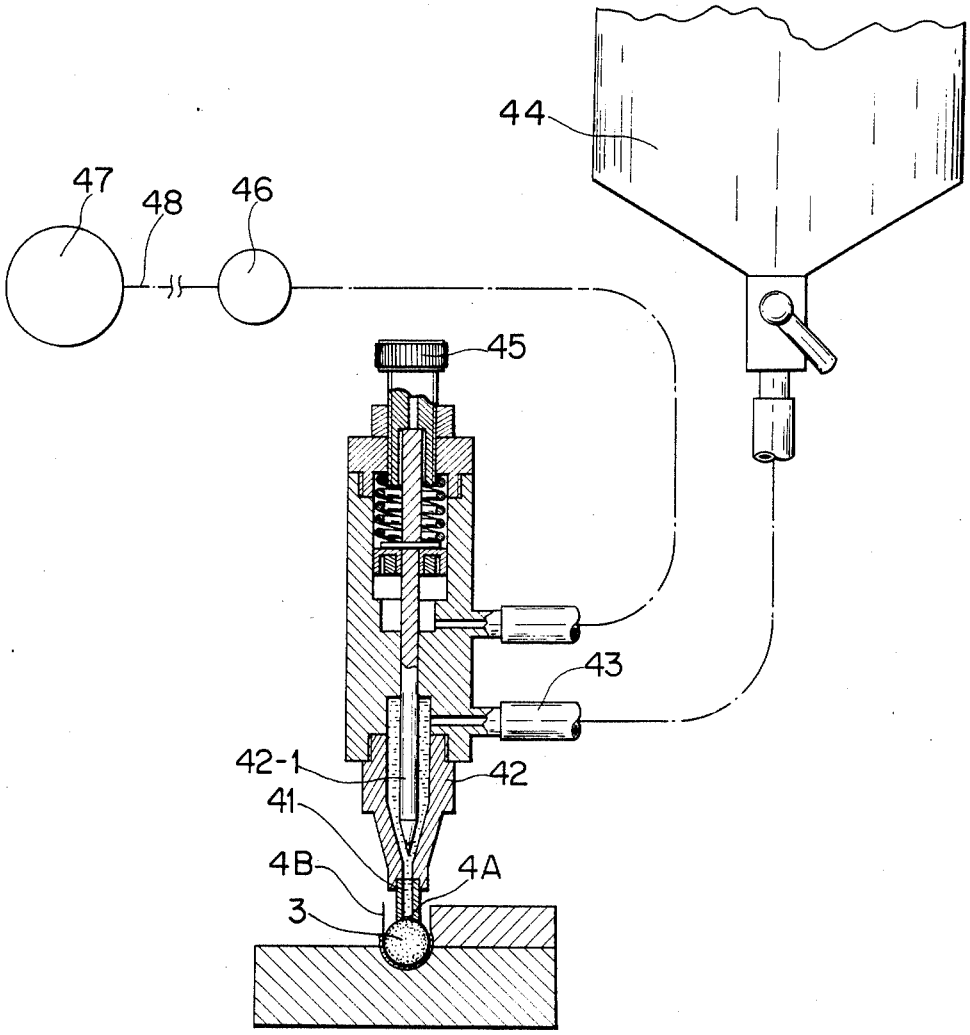
FIG. 8 is a schematic view showing the paste applying unit.

The paste applying section 40, as shown in FIG. 8, includes paste nozzle 41, needle valve 42, paste pipe 43, paste tank 44, solenoid valve 46, and pneumatic pipe 48. Said paste applying section 40 is arranged such that said paste nozzle 41 faces filter components 3-1 and 3-2 between the first upper guide 34 and the second upper guide 35 and preferably immediately downstream of said first upper guide 34 as shown in FIG. 3.

Referring back to FIG. 8, paste in the tank 44 is supplied through the pipe 43 to the needle valve 42. The needle valve 42 is connected to an external air pressure source via solenoid valve 46 and pipe 48 for open-close operation. The elevated position of the needle 42-1 can be adjusted by adjustment screw 45 for adjusting the amount of paste to be delivered. The solenoid valve 46 is operated by a signal from a control circuit (not shown) to move the needle 42-1 up and down so as to stop the delivery of paste when the machine stops. The paste tank 44 is positioned about 80 cm above the nozzle 41 and it is desirable that the internal diameter of the paste pipe 43 be approximately 9 mm and the viscosity of paste about 1,000 CP.

The nozzle 41 is preferably formed of trifluoro or tetrafluoro resin, which has low affinity to the paste, to prevent paste from sticking to the nozzle. The nozzle 41 is about 3 mm in inner diameter and about 1.5 mm in thickness. The shape of the nozzle tip is preferably formed into an arc to fit the circumference of the filter bar, but there is no big difference in performance if the nozzle tip is formed flat.

Figure 1:
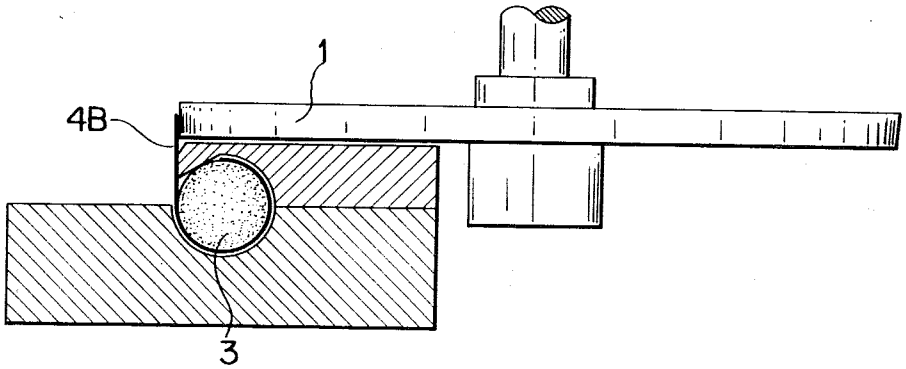
FIG. 1 is a simplified cross-sectional view of a main portion of the conventional paste applying device.
Figure 3:
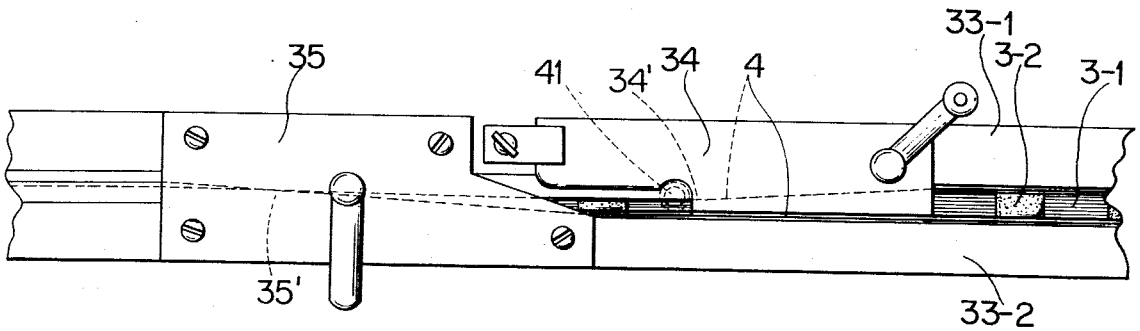
FIG. 3 is a top view of the filter wrapping paper folding unit with the pasted applying means installed at the center.
Figure 7:
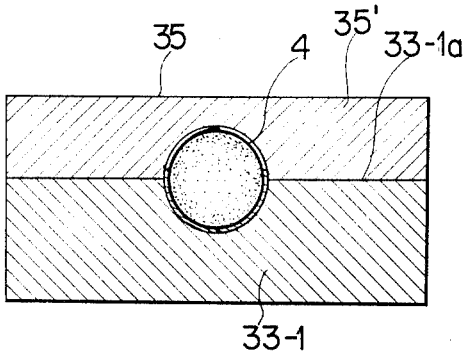

The nozzle 41, as shown in FIG. 3, is mounted between the first folding guide 34 and the second folding guide 35 such that the nozzle tip is placed in contact with the surface of the filter wrapping paper end 4A, as shown is FIG. 6, which is to be lapped over by the other end 4B of paper when the paper is folded around the filter component 3 at the succeeding process (see FIG. 7). The nozzle tip may also be placed in contact with both the paper end 4A and a part of the filter component 3.

Figure 10:
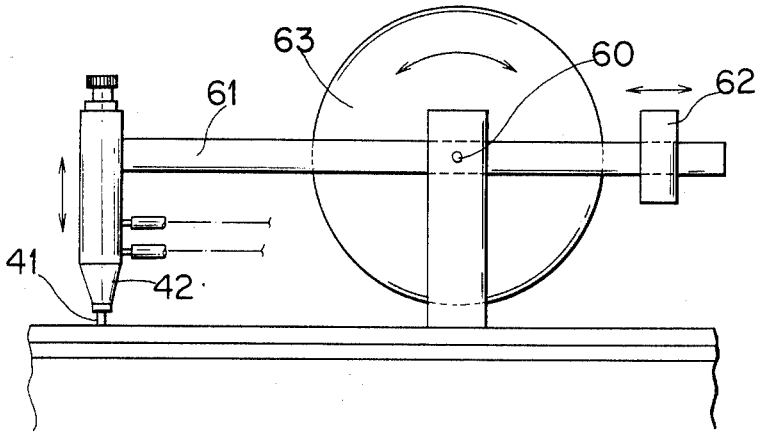
FIG. 10 is a simplified side view of a mechanism involving the needle valve.

The needle valve 42, as shown in FIG. 10, is secured to one end of a lever 61 which pivots on axis 60 and has a balance weight 62 at the other end slidable along its length. Designated 63 is a weight attached to the lever 61 for the purpose of increasing the weight of this mechanism. With this mechanism it is possible to adjust to any desired pressure the contact pressure of the paste nozzle 41 against the filter wrapping paper and the filter component. The contact pressure is preferably set at approximately 200 g. If the nozzle tip should wear, the contact pressure can be maintained almost constant. For variations in external diameter and hardness of the filter component, which may occur at small intervals, the weight 63 acts to reduce vertical fluctuation of the nozzle 41 thus preventing the nozzle 41 from parting from the filter wrapping paper and the filter component.

The drying section 50 is installed above the tape belt 32 at the rear stage of the second folding guide 35 in such a way as to contact the filter bar.

The process of forming the filter by the filter wrapping paper folding section 30, pasting section 40 and drying section 50 is explained below, referring to FIGS. 4 through 7. The tape belt 32 and the filter wrapping paper 4 are bent into a shape of letter U by the lower guide 33-1 and preliminary guides 33-2, and 33-3 installed to receive the fed filter components in nesting fashion. Then the first part of filter wrapping paper 4A adjacent its first edge is folded around the filter components by the first projection 34' of the first upper guide 34 such that the second surface of tape 32 faces radially outwardly and is applied from the tip of the nozzle 41 to the second surface of the first part 4A or both the second surface of the first part 4A and the surface of the filter componens 3-1 and 3-2. After this, the second part 4B adjacent the second edge of the filter wrapping paper 4 is folded around the filter component by the second projection 35' of the second upper guide 35 and is lapped over the first part 4A of paper 4. The filter wrapping paper thus wrapped around the filter and fixed by paste is then dried by the drying means 50 provided downstream of said second upper guide 35.

Figure 9:
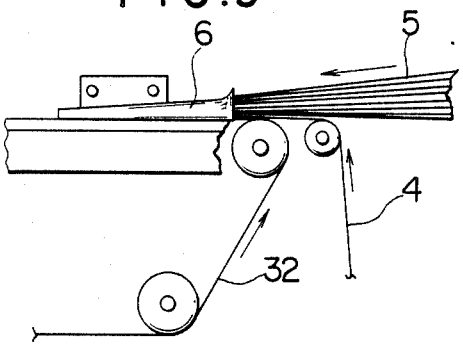
FIG. 9 is simplified side view showing the filter component supplying unit when a tow is used as filter component
Figure 11:
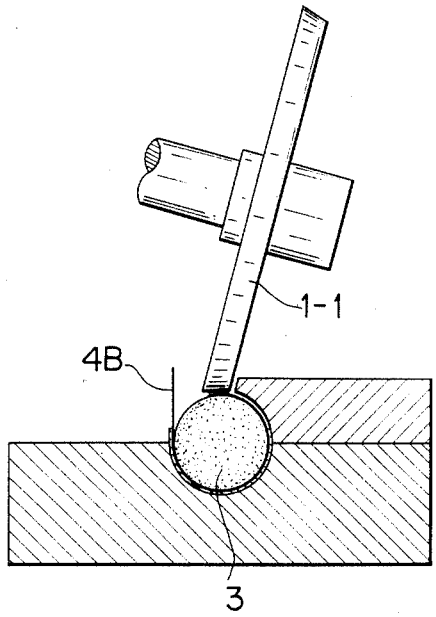
FIG. 11 is a simplified cross-sectional view of the paste applying unit having a paste transfer roller.

This invention is applicable to a triple filter which is formed by stopping either of the two hoppers 13-1, 13-2 of FIG. 2 to form a hollow space in the filter and filling active carbon into the hollow space. It is also applicable to a filter making machine which utilizes a plane filter supply unit in which, as shown in FIG. 9, filter component such as filter tow 5 is compressed and formed into a circular bar by the compressing member 6 and then transferred to the next process.

paste applying unit 40 may be replaced with the one using a paste transfer roller 1-1 as shown in FIG. 11. Said paste pipe 43 and paste tank 44 of paste applying unit 40 used for applying vinyl acetate paste may be replaced with a known hot-melt paste nozzle, in which case the drying section 50 is replaced with a cooling section or said cooling section is installed downstream of the drying section 50.

As can be seen from the foregoing, since with this invention paste is applied to the surface of one end of filter wrapping paper which is to be lapped over by the other end, or to both the surface of said filter wrapping paper end and the surface of the filter component, there is no fear of the paste oozing to the surface of the filter wrapping paper as is the case with the conventional device when high air-permeable paper and vinyl acetatge paste are used. This eliminates machine troubles resulting from the ooze of paste to the paper surface and also substantially reduces the amount of inferior goods. Conventional apparatuses are provided with a paste applying device for the filter wrapping paper and a reil paste applying device for fixing the filter component. With the preferred embodiment of this invention it is possible to eleminate the rail paste applying device, resolve the problem of dried paste sticked to the tape caused by oozing of paste applied by the rail, and dry the paste applied by the rail.

What is claimed is:

1. A method of manufacturing tobacco filters comprising the steps of feeding a tape of filter wrapping paper having first and second surfaces, and first and second edges, said tape being in a substantially stretched condition;

supplying rod-shaped filter components on said first surface in train without gap therebetween each having a predetermined circumference, said tape having an edge-to-edge size larger than said circumference;

guiding said tape at a first part thereof adjacent said first edge around the rod-shaped filter components such that said second surface faces radially outwardly;

applying paste on only said second surface of the tape at said first part; and guiding said tape at a second part thereof adjacent said second edge around each rod-shaped filter component to lap over said paste-applied first part to form a wrapped piece of filter components.

2. A method according to claim 1, further including a step of heating said wrapped filter components.

3. An apparatus for manufacturing tobacco filters comprising means for feeding a tape of filter wrapping paper in a substantially stretched condition in a predetermined direction, said tape having first and second surfaces and first and second edges;

means for supplying rod-shaped filter components in train without gaps therebetween longitudinally on said first surface of the tape;

means for guiding said tape at a first part thereof adjacent said first edge around the rod-shaped filter components such that said second surface faces radially outwardly and said second edge extends tangentially to said filter component and for guiding said tape at second part thereof adjacent said second edge around the rod-shaped filter component to lap over said first part; and means provided within said guide means for applying paste on said second surface of the tape at an area adjacent the first edge after the tape is guided at said first part around the rod-shaped filter component and before the tape is guided at said second part thereof around the rod-shaped filter components, whereby a wrapped piece of filter components is formed.

4. An apparatus for manufacturing tobacco filters according to claim 3, wherein said paste applying means is adapted to apply paste to only said first part adjacent the first edge.

5. An apparatus for manufacturing tobacco filters according to claim 3, wherein said paste applying means is adapted to apply paste to both said first part and exposed part of said filter components adjacent the first edge of the tape.

6. An apparatus for manufacturing tobacco filters according to claim 4 or 5, wherein said paste applying means includes a nozzle-type paste applicator.

7. An apparatus for manufacturing tobacco filters according to claim 6, wherein said nozzle-type paste applicator is adaped to adjustably come into and go out of contact with said first part.

8. An apparatus for manufacturing tobacco filter according to claim 3, wherein said paste applying means includes a paste transfer applicator.

9. An apparatus for manufacturing tobacco filters according to claim 3, wherein said guide means includes an elongated common lower guide, and first and second upper guides, said elongated common lower guide extending beneath the tape feeding means in said predetermined direction and having a lower semi-circular groove formed therein facing upward and first and second elevated surfaces on both sides thereof, said first upper guide mounted on said first elevated surface at upstream portion thereof, said first upper guide having a substantially same width as said first elevated surface at a most upstream portion thereof but having a first projection extending over said lower semi-circular groove increasingly toward a downstream portion thereof, said first projection being formed with a first upper semi-circular groove aligning with the lower semi-circular groove to define a first guide passage, said second upper guide mounted on said second elevated surface at downstream portion thereof, said second upper guide having a substantially same width as said second elevated surface at a most upstream portion thereof but having a second projection extending over said lower semi-circular groove increasingly toward a downstream portion thereof, said second projection being formed with a second upper semi-circular groove aligning with the lower semi-circular to define a second guide passage, said first and second guides being separate from each other to form a space therebetween to receive said paste applying means therein.

10. An apparatus for manufacturing tobacco filters according to claim 3, further including means for drying said wrapped piece of filter components downstream of said guide means.

11. A method of manufacturing tobacco filters comprising the steps of feeding a tape of filter wrapping material having first and second surfaces, and first and second edges, said tape being in a substantially stretched condition;

supplying rod-shaped filter components on said first surface in train without gap therebetween each having a predetermined circumference, said tape having an edge-to-edge size larger than said circumference;

guiding said tape at a first part thereof adjacent said first edge around the rod-shaped filter components such that the second surfaces faces radially outwards;

applying paste on both the second surface of the tape at said first part and said filter components at an exposed part thereof adjacent the first edge of the tape; and guiding said tape at a second part thereof adjacent said second edge around each rod-shaped filter component to lap over said paste-applied first part to form a wrapped piece of filter components.

12. A method according to claim 11, further including a step of heating said wrapped filter components.

* * * * *